US011384724B2

(12) United States Patent
Campton et al.

(10) Patent No.: US 11,384,724 B2
(45) Date of Patent: Jul. 12, 2022

(54) PERMANENTLY ENGAGED STARTER SYSTEM

(71) Applicant: BorgWarner Inc., Auburn Hills, MI (US)

(72) Inventors: Calahan B. Campton, Royal Oak, MI (US); Michael W. Campbell, Royal Oak, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 17/332,469

(22) Filed: May 27, 2021

(65) Prior Publication Data

US 2021/0372356 A1 Dec. 2, 2021

Related U.S. Application Data

(60) Provisional application No. 63/032,706, filed on May 31, 2020.

(51) Int. Cl.
*F02N 15/02* (2006.01)

(52) U.S. Cl.
CPC ..... *F02N 15/023* (2013.01)

(58) Field of Classification Search
CPC ..... F02N 15/023; F16D 13/16; F16D 41/07
See application file for complete search history.

(56) References Cited

U.S. PATENT DOCUMENTS 8,091,696 B2 1/2012 Wittkopp et al.
9,803,611 B2 10/2017 Showalter
10,018,230 B2 7/2018 Peglowski
10,274,026 B2 4/2019 Veit et al.
10,619,701 B2 4/2020 Maguire et al.
(Continued)

FOREIGN PATENT DOCUMENTS

DE 102008003810 A1 7/2008
DE 102011005049 A1 9/2012
(Continued)

OTHER PUBLICATIONS

English language abstract for DE 10 2008 003 810 A1 extracted from espacenet.com database on Jun. 9, 2021, 2 pages.
(Continued)

*Primary Examiner* — David M Fenstermacher
(74) *Attorney, Agent, or Firm* — Howard & Howard Attorneys PLLC

(57) ABSTRACT

A permanently engaged starter system for use in a vehicle includes a flex plate. The vehicle includes a crankshaft and an engine block. The flex plate extends along and is rotatable about an axis. The flex plate is adapted to be rotatably coupled to the crankshaft. The permanently engaged starter system also includes a one-way clutch including an outer and inner race. The permanently engaged starter system additionally includes a ring gear rotatably coupled to one of the inner race and the outer race of the one-way clutch. The permanently engaged starter system further includes a starter support plate, and a pilot support plate coupled to the ring gear. The pilot support plate is fixedly coupled to the starter support plate and is configured to axially and radially align and retain the ring gear and one of the inner race and the outer race with respect to the axis.

20 Claims, 3 Drawing Sheets

(56) References Cited

U.S. PATENT DOCUMENTS

| | | | | |
|---|---|---|---|---|
| 2002/0104499 | A1* | 8/2002 | Sanada | F02N 99/004 123/179.3 |
| 2002/0179392 | A1 | 12/2002 | Quigley | |
| 2010/0288592 | A1 | 11/2010 | Papania et al. | |
| 2013/0218432 | A1* | 8/2013 | Kudo | F02N 15/027 701/67 |
| 2015/0060222 | A1 | 3/2015 | Showalter | |
| 2015/0114783 | A1* | 4/2015 | Baeumler | F16D 41/066 192/45.018 |
| 2015/0176557 | A1* | 6/2015 | Champalou | F16D 41/07 74/7 C |
| 2017/0058852 | A1* | 3/2017 | Takagi | F02N 15/022 |
| 2017/0122386 | A1 | 5/2017 | Veit et al. | |
| 2017/0284480 | A1* | 10/2017 | Veit | F02N 15/023 |
| 2018/0073568 | A1* | 3/2018 | Peglowski | F16D 43/18 |
| 2018/0100555 | A1 | 4/2018 | Shih | |
| 2021/0372356 | A1* | 12/2021 | Campton | F02N 15/023 |
| 2022/0003279 | A1* | 1/2022 | Lin | F16D 41/061 |
| 2022/0065212 | A1* | 3/2022 | Campton | F02N 15/026 |

FOREIGN PATENT DOCUMENTS

| | | | |
|---|---|---|---|
| DE | 102015204660 | A1 | 9/2016 |
| DE | 102015008895 | A1 | 1/2017 |
| DE | 102015014029 | A1 | 5/2017 |
| DE | 102019001087 | A1 | 8/2020 |
| DE | 102019007593 | A1 | 5/2021 |
| DE | 102019008865 | A1 | 6/2021 |

OTHER PUBLICATIONS

Machine-assisted English language abstract and machine-assisted English translation for DE 10 2011 005 049 A1 extracted from espacenet.com database on Jun. 9, 2021, 10 pages.

Machine-assisted English language abstract and machine-assisted English translation for DE 10 2015 204 660 A1 extracted from espacenet.com database on Jun. 9, 2021, 14 pages.

Machine-assisted English language abstract and machine-assisted English translation for DE 10 2015 008 895 A1 extracted from espacenet.com database on Jun. 9, 2021, 22 pages.

English language abstract for DE 10 2015 014 029 A1 extracted from espacenet.com database on Jun. 9, 2021, 2 pages.

Machine-assisted English language abstract and machine-assisted English translation for DE 10 2019 001 087 A1 extracted from espacenet.com database on Jun. 9, 2021, 20 pages.

Machine-assisted English language abstract and machine-assisted English translation for DE 10 2019 007 593 A1 extracted from espacenet.com database on Jun. 9, 2021, 23 pages.

Machine-assisted English language abstract and machine-assisted English translation for DE 10 2019 008 865 A1 extracted from espacenet.com database on Jun. 30, 2021, 23 pages.

* cited by examiner

PERMANENTLY ENGAGED STARTER SYSTEM

CROSS-REFERENCE TO RELATED APPLICATIONS

The present application claims priority to and all the benefits of U.S. Provisional Application No. 63/032,706 filed on May 31, 2020, the disclosure of which is incorporated by reference in its entirety.

BACKGROUND OF THE INVENTION

1. Field of the Invention

The present invention generally relates to a permanently engaged starter system and, more specifically, to a permanently engaged starter system for use in a vehicle.

2. Description of the Related Art

Conventional permanently engaged starter systems include a flex plate rotatably coupled to a crankshaft of a vehicle, a clutch rotatably coupled to the flex plate, a ring gear rotatably coupled to the clutch, and a starter motor including a pinion gear rotatably coupled to the ring gear for providing rotational torque to the crankshaft through the clutch and the flex plate. However, conventional permanently engaged starter systems are often costly, occupy substantial space in an engine bay, and are limited in their configurations and orientations within the engine bay.

As such, there remains a need to provide an improved permanently engaged starter system.

SUMMARY OF THE INVENTION AND ADVANTAGES

A permanently engaged starter system for use in a vehicle includes a flex plate. The vehicle includes crankshaft and an engine block. The flex plate extends along and is rotatable about an axis. The flex plate is adapted to be rotatably coupled to the crankshaft. The permanently engaged starter system also includes a one-way clutch including an outer race disposed about the axis and rotatably coupled to the flex plate, and an inner race disposed about the axis and disposed between the outer race and the axis. The permanently engaged starter system further includes a ring gear rotatably coupled to one of the inner race and the outer race of the one-way clutch. The permanently engaged starter system additionally includes a starter support plate and a pilot support plate coupled to the ring gear. The pilot support plate is fixedly coupled to the starter support plate and is configured to axially and radially align and retain the ring gear and one of the inner race and the outer race with respect to the axis.

Accordingly, having the pilot support plate fixedly coupled to the starter support plate and configured to axially and radially align and retain the ring gear one of the inner race and the outer race with respect to the axis reduces axial packaging and dimensional stack up of the permanently engaged starter system, and removes the need for fasteners to couple the pilot support plate directly to the engine block.

BRIEF DESCRIPTION OF THE DRAWINGS

Other advantages of the present invention will be readily appreciated, as the same becomes better understood by reference to the following detailed description when considered in connection with the accompanying drawings.

DETAILED DESCRIPTION OF THE INVENTION

Figure 1:
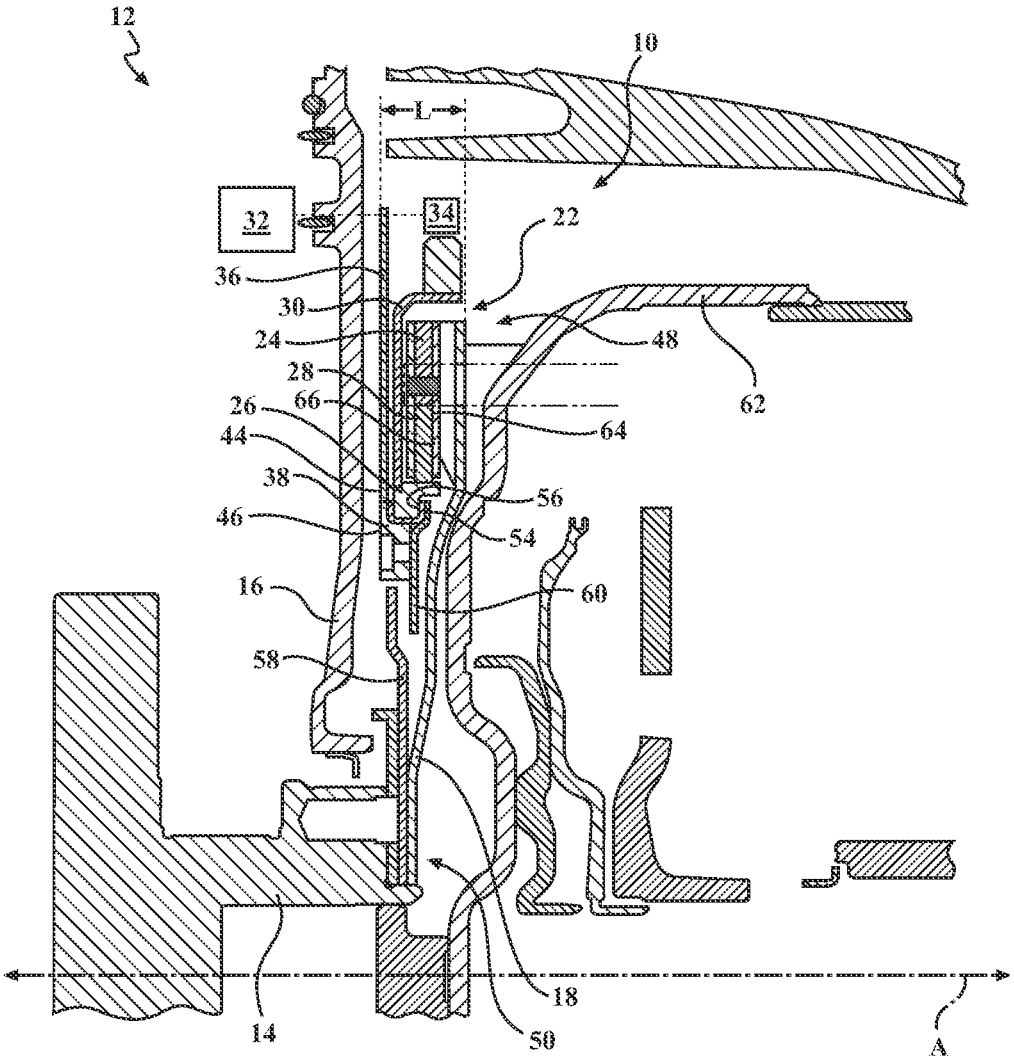
FIG. 1 is a cross-sectional view of the permanently engaged starter system including a flex plate, a one-way clutch, a ring gear, a starter support plate, and a pilot support plate.

With reference to the Figures, wherein like numerals indicate like parts throughout the several views, a permanently engaged starter system 10 for use in a vehicle 12 is generally shown in a cross-sectional view in FIG. 1. The vehicle 12 includes a crankshaft 14 and an engine block 16 of an internal combustion engine (not shown). The vehicle 12 may be a conventional vehicle propelled solely by the internal combustion engine or may be a hybrid vehicle that is propelled by both the internal combustion engine and an electric motor.

The permanently engaged starter system 10 includes a flex plate 18 extending along and rotatable about an axis A. The flex plate 18 is adapted to be rotatably coupled to the crankshaft 14. The permanently engaged starter system 10 further includes a one-way clutch 22 including an outer race 24 disposed about the axis A and rotatably coupled to the flex plate 18, and an inner race 26 disposed about the axis A and disposed between the outer race 24 and the axis A. The one-way clutch 22 may be as a roller type one-way clutch comprising a plurality of rollers 28 disposed between the outer and inner race 24, 26. The one-way clutch 22 may include a first side plate 64 and a second side plate 66 spaced axially from the first side plate 64, with first and second side plates 64, 66 coupled to the outer and inner races 24, 26.

With continued reference to FIG. 1, the permanently engaged starter system 10 also includes a ring gear 30 rotatably coupled to one of the inner race 26 and the outer race 24 of the one-way clutch 22. In one embodiment, the ring gear 30 is rotatably coupled to the inner race 26 of the one-way clutch 22. In another embodiment, the ring gear 30 is rotatably coupled to the outer race 24 of the one-way clutch 22. Although not required, the permanently engaged starter system 10 may include a starter motor 32 including a pinion gear 34 rotatably coupled to the ring gear 30 for providing rotational torque to the crankshaft 14 through the inner race 26, the outer race 24, and the flex plate 18. The pinion gear 34 is typically permanently engaged with the ring gear 30, resulting in a permanently engaged starter system.

Figure 2:
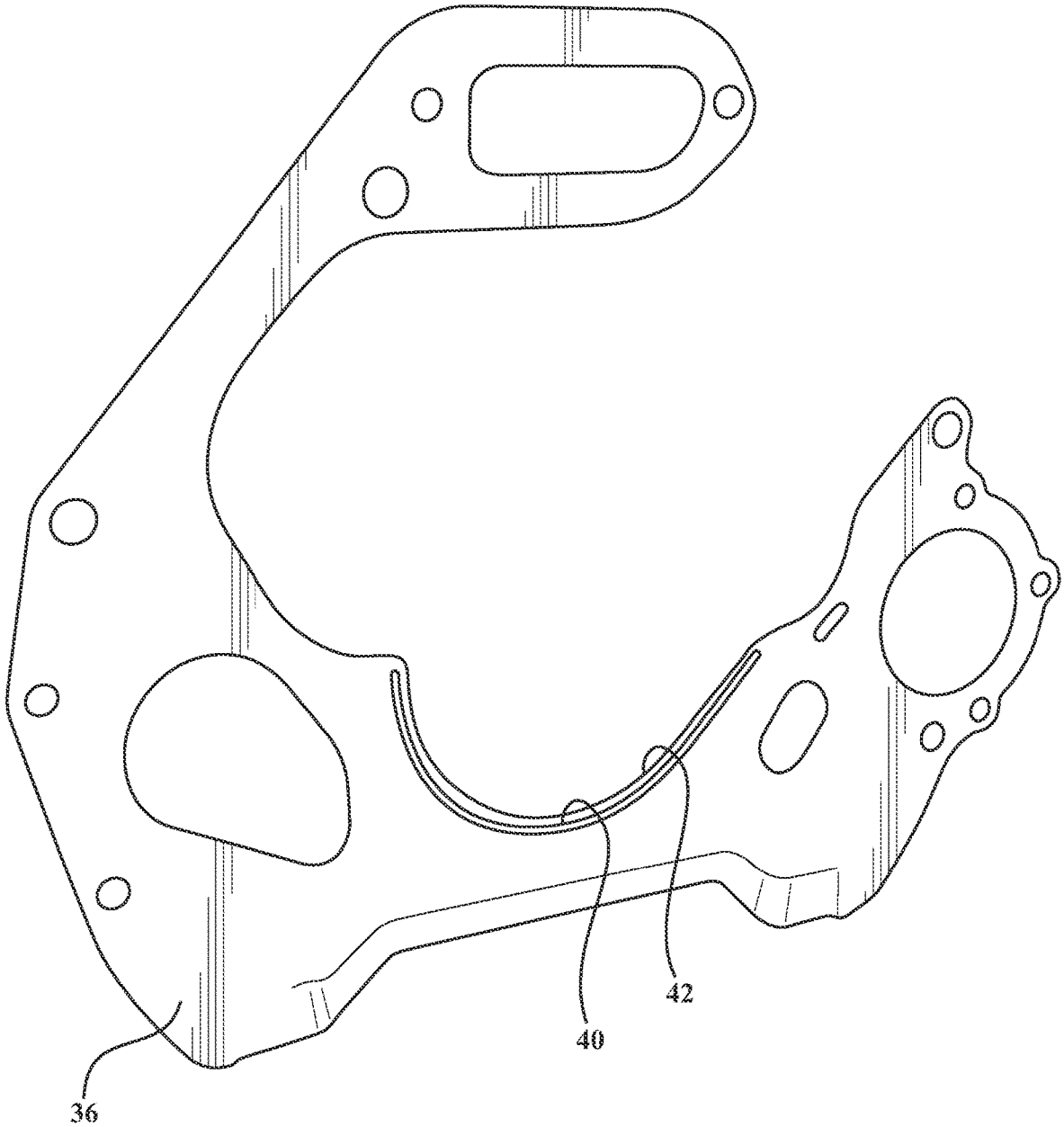
FIG. 2 is a perspective view of one embodiment of the starter support plate.
Figure 3:
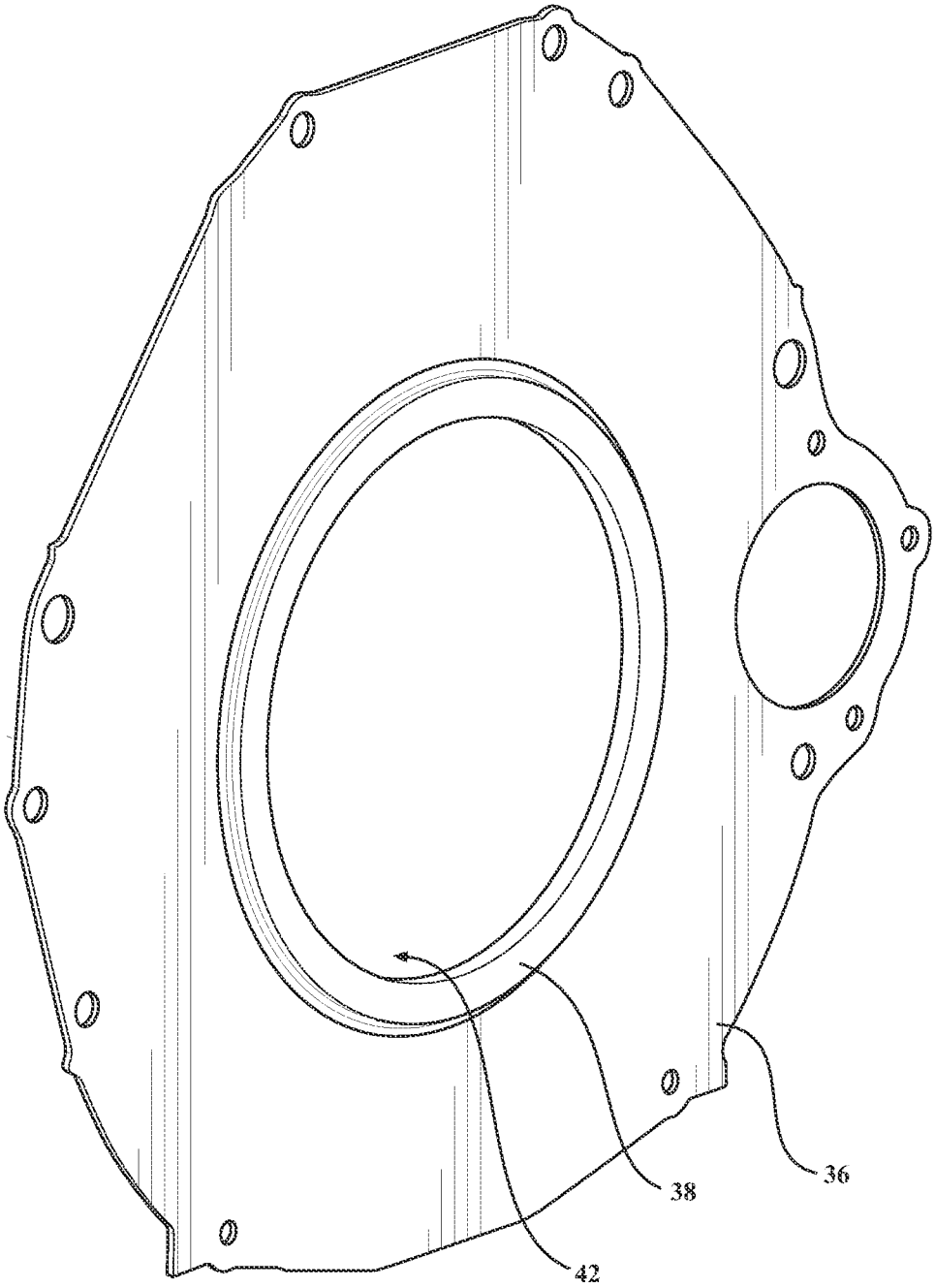
FIG. 3 is a perspective view one embodiment of the starter support plate and the pilot support plate.

The permanently engaged starter system 10 additionally includes a starter support plate 36. The starter support plate 36 is shown in FIGS. 1-3 and is shown in perspective view in FIGS. 2 and 3. The permanently engaged starter system 10 also includes a pilot support plate 38 coupled to the ring gear 30, as shown in FIG. 1. The pilot support plate 38 is also shown in a perspective view with the starter support plate 36 in FIG. 2. The pilot support plate 38 may have an annular configuration and be disposed about the axis A. The pilot support plate 38 is fixedly coupled to the starter support plate 36 and is configured to axially and radially align and retain the ring gear 30 and one of the inner race 26 and outer race 24 with respect to the axis A. In other words, the pilot support plate 38 is stationary with respect to the starter support plate 36 during operation of the permanently engaged starter system 10, which allows the pilot support plate 38 to axially and radially align and retain the ring gear 30 and one of the inner race 26 and outer race 24 with respect to the axis A. For example, when the ring gear 30 is rotatably coupled to the inner race 26 of the one-way clutch 22, the pilot support plate 38 is fixedly coupled to the starter support plate 36 and is configured to axially and radially align and retain the ring gear 30 and the inner race 26 with respect to axis A. When the ring gear 30 is rotatably coupled to the outer race 24 of the one-way clutch 22, the pilot support plate 38 is fixedly coupled to the starter support plate 36 and is configured to axially and radially align and retain the ring gear 30 and the outer race 24 with respect to axis A. Because the pilot support plate 38 is fixedly coupled to the starter support plate 36, the starter support plate 36 and the pilot support plate 38 are stationary with respect to one another during operation of the permanently engaged starter system 10. In particular, the pilot support plate 38 is grounded with respect to the engine block 16, which secures the remaining components, in particular the one-way clutch 22 and the ring gear 30. In one embodiment, the starter support plate 36 is adapted to be fixedly coupled to the engine block 16 such that the starter support plate 36 is stationary with respect to the axis A. Having the starter support plate 36 adapted to be fixedly coupled to the engine block 16 allows the permanently engaged starter system 10 to be mounted to the engine block 16 in numerous locations and, therefore, eliminates the need to modify the engine block 16, for example the back of the engine block 16, to fixedly couple the starter support plate 36 thereto.

Additionally, having the pilot support plate 38 fixedly coupled to the starter support plate 36 and configured to axially and radially align and retain the ring gear 30 and the inner race 26 with respect to the axis A reduces axial packaging of the permanently engaged starter system 10, as described in examples below. For example, having the pilot support plate 38 fixedly coupled to the starter support plate 36 and configured to axially and radially align and retain the ring gear 30 and the inner race 26 with respect to the axis A removes the need for fasteners to couple the pilot support plate 38 directly to the engine block 16, which further reduces axial packaging and reduces dimensional stack up as components of the permanently engaged starter system 10 are able to be placed closer together.

The starter support plate 36 may have an interior starter surface 40 defining an aperture 42. When the starter support plate 36 has the interior starter surface 40 defining the aperture 42, the pilot support plate 38 is typically engaged with the interior starter surface 40 and disposed within the aperture 42. This reduces axial packaging of the permanently engaged starter system 10.

The pilot support plate 38 may be spaced from the engine block 16 with respect to the axis A. Having the pilot support plate 38 spaced from the engine block 16 with respect to the axis A further helps with packaging of the permanently engaged starter system 10.

The starter support plate 36 may have a first starter surface 44 facing away from the one-way clutch 22 with respect to the axis A and adapted to face the engine block 16. The pilot support plate 38 may have a first pilot surface 46 facing away from the one-way clutch 22 with respect to the axis A and adapted to face the engine block 16. The first starter surface 44 and the first pilot surface 46 may be parallel to one another with respect to the axis A. Having the first starter surface 44 and the first pilot surface 46 parallel to one another with respect to the axis A further reduces axial packaging and reduces dimensional stack up of the components of the permanently engaged starter system 10. In one embodiment when the first starter surface 44 and the first pilot surface 46 are parallel to one another, the first starter surface 44 and the first pilot surface 46 may be flush with one another with respect to the axis A, which, again, further reduces axial packaging and reduces dimensional stack up of the components of the permanently engaged starter system 10.

The flex plate 18 has a first flex end 48 spaced from the axis A and adjacent the one-way clutch 22, and a second flex end 50 adjacent the axis A and disposed between the axis A and the first flex end 48 with respect to the axis A. The first flex end 48 and the starter support plate 36 define a length L that is less than 25 mm with respect to the axis A. In part, the length L is able to be less than 25 mm because the axial packaging is reduced as a result of the pilot support plate 38 is fixedly coupled to the starter support plate 36 and is configured to axially and radially align and retain the ring gear 30 and the inner race 26 with respect to the axis A.

The permanently engaged starter system 10 may include a bushing 54 fixedly coupled to the pilot support plate 38. When present, the bushing 54 rotatably supports the ring gear 30 and the inner race 26 of the one-way clutch 22 as the ring gear 30 rotates about the axis A with respect to the pilot support plate 38. The bushing 54 may define a bushing channel 56, and when present the bushing channel 56 may receive the inner race 26 of the one-way clutch 22.

The vehicle 12 may include a torque converter 62 coupled to the flex plate 18.

As shown in FIG. 1, the permanently engaged starter system 10 may include a first contamination baffle 58 coupled to the flex plate 18 and adapted to be axially disposed between the flex plate 18 and the crankshaft 14. The permanently engaged starter system 10 may include a second contamination baffle 60 coupled to the pilot support plate 38. When present, the second contamination baffle 60 is grounded to the engine block 16 along with the starter support plate 36 and the pilot support plate 38.

What is claimed is:

1. A permanently engaged starter system for use in a vehicle including a crankshaft and an engine block, said permanently starter system comprising:

a flex plate extending along and rotatable about an axis, with said flex plate being adapted to be rotatably coupled to the crankshaft;

a one-way clutch comprising an outer race disposed about said axis and rotatably coupled to said flex plate, and an inner race disposed about said axis and disposed between said outer race and said axis;

a ring gear rotatably coupled to one of said inner race and said outer race of said one-way clutch;

a starter support plate;

a pilot support plate coupled to said ring gear; and wherein said pilot support plate is fixedly coupled to said starter support plate and is configured to axially and radially align and retain said ring gear and one of said inner race and said outer race with respect to said axis.

2. The permanently engaged starter system as set forth in claim 1 further comprising a starter motor comprising a pinion gear rotatably coupled to said ring gear for providing rotational torque to the crankshaft through said inner race, said outer race, and said flex plate.

3. The permanently engaged starter system as set forth in claim 1, wherein said starter support plate is adapted to be fixedly coupled to the engine block such that said starter support plate is stationary with respect to said axis.

4. The permanently engaged starter system as set forth in claim 1, wherein said starter support plate has an interior starter surface defining an aperture, and wherein said pilot support plate is engaged with said interior starter surface and disposed within said aperture.

5. The permanently engaged starter system as set forth in claim 1, wherein said pilot support plate is spaced from the engine block with respect to said axis.

6. The permanently engaged starter system as set forth in claim 1, wherein said starter support plate has a first starter surface facing away from said one-way clutch with respect to said axis and adapted to face the engine block, wherein said pilot support plate has a first pilot surface facing away from said one-way clutch with respect to said axis and adapted to face the engine block, and wherein said first support surface and said first pilot surface are parallel to one another with respect to said axis.

7. The permanently engaged starter system as set forth in claim 6, wherein said first starter surface and said first pilot surface are flush with one another with respect to said axis.

8. The permanently engaged starter system as set forth in claim 1, wherein said pilot support plate has an annular configuration and is disposed about said axis.

9. The permanently engaged starter system as set forth in claim 1 further comprising a bushing fixedly coupled to said pilot support plate, wherein said bushing rotatably supports said ring gear and said inner race of said one-way clutch as said ring gear rotates about said axis with respect to said pilot support plate.

10. The permanently engaged starter system as set forth in claim 9, wherein said bushing defines a bushing channel, and wherein said bushing channel receives said inner race of said one-way clutch.

11. The permanently engaged starter system as set forth in claim 1, wherein said one-way clutch is further defined as a roller type one-way clutch comprising a plurality of rollers disposed between said inner and said outer race.

12. The permanently engaged starter system as set forth in claim 1, wherein said one-way clutch further comprises a first side plate and a second side plate spaced axially from said first side plate, and wherein said first and second side plates are coupled to said outer and inner races.

13. The permanently engaged starter system as set forth in claim 1 further comprising a first contamination baffle coupled to said flex plate and adapted to be axially disposed between said flex plate and the crankshaft.

14. The permanently engaged starter system as set forth in claim 13 further comprising a second contamination baffle coupled to said pilot support plate.

15. The permanently engaged starter system as set forth in claim 1, wherein said flex plate has a first flex end spaced from said axis and adjacent said one-way clutch, and a second flex end adjacent said axis and disposed between said axis and said first flex end with respect to said axis, wherein said first flex end and said starter support plate define a length that is less than 25 mm with respect to said axis.

16. The permanently engaged starter system as set forth in claim 2, wherein said starter support plate is adapted to be fixedly coupled to the engine block such that said starter support plate is stationary with respect to said axis.

17. The permanently engaged starter system as set forth in claim 2, wherein said starter support plate has an interior starter surface defining an aperture, and wherein said pilot support plate is engaged with said interior starter surface and disposed within said aperture.

18. The permanently engaged starter system as set forth in claim 2, wherein said starter support plate has a first starter surface facing away from said one-way clutch with respect to said axis and adapted to face the engine block, wherein said pilot support plate has a first pilot surface facing away from said one-way clutch with respect to said axis and adapted to face the engine block, and wherein said first support surface and said first pilot surface are parallel to one another with respect to said axis.

19. A vehicle comprising:

said permanently engaged starter system as set forth in claim 2;

said crankshaft; and said engine block;

wherein said starter support plate is fixedly coupled to said engine block such that said starter support plate is stationary with respect to said axis.

20. The vehicle as set forth in claim 19 further comprising a torque converter rotatably coupled to said flex plate.

* * * * *